US007739955B2

(12) United States Patent
Rönn et al.

(10) Patent No.: US 7,739,955 B2
(45) Date of Patent: Jun. 22, 2010

(54) DEVICE ADJACENT TO AN EXPLOSIVE CHARGE WITH AT LEAST TWO LINERS

(75) Inventors: Torsten Rönn, Karlskoga (SE); Christer Thuman, Karlskoga (SE)

(73) Assignee: BAE Systems Bofors AB, Karlskoga (SE)

( * ) Notice: Subject to any disclaimer, the term of this patent is extended or adjusted under 35 U.S.C. 154(b) by 424 days.

(21) Appl. No.: 10/558,754

(22) PCT Filed: Jun. 3, 2004

(86) PCT No.: PCT/SE2004/000854

§ 371 (c)(1),
(2), (4) Date: Mar. 16, 2007

(87) PCT Pub. No.: WO2004/109219

PCT Pub. Date: Dec. 16, 2004

(65) Prior Publication Data

US 2007/0214991 A1 Sep. 20, 2007

(30) Foreign Application Priority Data

Jun. 4, 2003 (SE) ..... 0301611

(51) Int. Cl.
*F42B 12/00* (2006.01)

(52) U.S. Cl. ..... 102/476; 89/1.15; 102/305; 102/306

(58) Field of Classification Search ..... 102/476, 102/305, 306, 307–310; 89/1.15
See application file for complete search history.

(56) References Cited

U.S. PATENT DOCUMENTS 3,726,224 A * 4/1973 Pugh et al. ..... 102/476
3,732,816 A * 5/1973 Muller ..... 102/306
3,732,818 A * 5/1973 Thomanek ..... 102/306
3,750,582 A * 8/1973 Kintish et al. ..... 102/476

(Continued)

FOREIGN PATENT DOCUMENTS

DE 3628622 8/1996

(Continued)

OTHER PUBLICATIONS

International Search Report No. PCT/SE2004/000854, dated Sep. 9. 2004, 4 pages.

*Primary Examiner*—Michael Carone
*Assistant Examiner*—Gabriel J Klein
(74) *Attorney, Agent, or Firm*—Connolly Bove Lodge & Hutz LLP

(57) ABSTRACT

An explosive charge (3) can be equipped with two liners (4, 5) that can be attached to one another. The primary liner (4) is so devised that when choosing a first choice (11) of being able to work independently and by employing a symmetrical form achieving a forward-aimed Shaped Charge Warhead (SCW) effect upon explosive charge initiation by means of the material (7, 8) indicated for the primary liner. A secondary liner (5) is devised with a second choice (12) to be able to work together with the primary liner and together cause an asymmetric form that distributes the material (18, 19) from the liners at different velocities to thereby cause a forward-directed fragmentation effect. The ammunition unit (1) can, thus, be designed or prepared for two different combat cases in a technologically simple and unambiguous manner.

18 Claims, 3 Drawing Sheets

U.S. PATENT DOCUMENTS

| | | | | |
|---|---|---|---|---|
| 4,004,518 | A * | 1/1977 | Potteiger et al. | 102/495 |
| 5,505,136 | A | 4/1996 | Cauchetier et al. | |
| 5,509,357 | A * | 4/1996 | Lawther | 102/307 |
| 5,792,980 | A | 8/1998 | Weimann | |
| 6,186,070 | B1 * | 2/2001 | Fong et al. | 102/476 |
| 6,510,797 | B1 * | 1/2003 | Fong | 102/476 |
| 7,451,704 | B1 * | 11/2008 | Gold et al. | 102/495 |

FOREIGN PATENT DOCUMENTS

| | | |
|---|---|---|
| DE | 3609865 | 7/1997 |
| GB | 1 036 337 | 7/1966 |
| WO | WO-02/03010 | 1/2002 |

* cited by examiner

[cm]
20
22
21
4
2
0
-2
-4

23
xz-plane
24b
24
24a
21
25a
25
25b

[cm]
22'
26 xz-plane
22'

DEVICE ADJACENT TO AN EXPLOSIVE CHARGE WITH AT LEAST TWO LINERS

TECHNICAL AREA

The present invention relates to a device at an explosive charge with at least two to each other arrangeable liners, such that different combat capabilities are made possible. A liner, here, refers in part to the Shaped Charge liner and in part to a liner with a, preferable, fragmentation effect.

PROBLEM PRESENTATION, BACKGROUND TO INVENTION AND KNOWN TECHNOLOGY

It is priorly known to arrange ammunition units/projectiles to accomplish different combat situations, e.g., in a first case to effect a Shaped Charge Warhead (SCW) function against hard targets and in a second case to effect fragmentation function against soft targets. It is also known how to arrange the explosive charge with two or more liners and how to arrange these such that a dispersed warhead effect is achieved, see e.g. U.S. Pat. No. 6,510,797 B1. It is also known to use liners with varied thickness, see e.g. U.S. Pat. No. 5,522,319 and U.S. Pat. No. 4,590,861. There are also general reference to and due notice of EP 1 164 348 and U.S. Pat. No. 5,939,663.

INVENTION'S OBJECTIVE AND DISTINGUISHING CHARACTERISTICS

Constant development is ongoing in relation to ammunition units of the named type and there is an existing need to be able to obtain refined and distinct warhead effects. Thus, e.g., it may be so desired to achieve effective SCW—and fragmentation discharge functions as well as having a simple manner of making the selection of each function. There is also an existing need to be able to achieve technological and economic advantages in ammunition production. One objective of the present invention is to address this problem.

The present invention is based upon the concept of using a symmetry from only applying a single SCW liner such that a secondary liner, e.g., a fragmentation charge liner, also applied shall both assembled liners in their functions provide an asymmetry where the SCW effect can not occur and a fragmentation warhead effect becomes possible instead.

The objectives so named, as well as other, here, non-enumerated purposes are achieved within the framework indicated in the present independent patent claims. Embodiments of the invention are indicated in the dependent patent claims.

That which can be mainly regarded as characteristic features for a device in accordance with the present invention is, among other things, that:

- the primary liner is arranged to, at a first selection, being able to function independently and by employment of a symmetrical form achieve a forward-aimed Shaped Charge Warhead (SCW) effect upon initiation of the explosive charge by means of the material emitted from the primary liner; and, the invention is also characterised by a secondary liner being arranged to, with a second selection, being able to function together with the primary liner and together with such cause an asymmetrical form or function that shall, upon the explosive charge initiation, confer different velocities to material emitted from the liners and, thus, cause a main forward-aimed fragmentation effect.

In a preferred embodiment for a device in accordance with the invention, it applies that:

- the primary and secondary liners may be arranged with an essentially convex form where the form opening is aimed forwardly in a direction of motion for an explosive charge supporting ammunition unit, e.g., a missile or projectile, and that a rear surface of the secondary liner may be so arranged so as to essentially correspond to the convex surface of the primary liner;
- the first liner may be so arranged as to be of essentially the same thickness as regards its radial and diametrical extensions;
- the secondary liner preferably may be arranged with a radially outwards and preferably evenly increasing thickness;
- that the secondary liner may also be arranged with a variation of thickness in angular or circumferential direction;
- the secondary liner's inner surface or convex surface may be regarded as being formed of a number of side-to-side fitting sector parts that are so fitted to each other as to enable the form named;
- the secondary liner's inner surface, in an alternative embodiment may be comprised of a number of partially outside each other arranged helical sub-surfaces;
- the secondary liner shall may a centre hole;
- the secondary liner may be designed in compact or prefragmented material;
- the primary and secondary liners may be devised from essentially the same material;
- given further embodiments, the secondary liner may be formed of brittle material;
- the ammunition unit (missile, projectile, etc.) in question may be equipped, during production, with primary and secondary liners and that the secondary liner may be arranged so as to be removable in cases of the first selection;

Further distinguishing characteristics can be inferred from the following patent requirements.

ADVANTAGES AND EFFECTS FROM THE INVENTION

The ammunition unit (missile, projectile, etc) can be easily arranged for different warhead functions by means of the proposals stipulated above. The selection of function may be made during production, during arming or during the trajectory of the ammunition unit toward a combated target.

LIST OF FIGURES

A currently proposed embodiment of a device displaying the characteristics that are significant for the present invention is described below with reference to the appended FIGS. 1-10 in which FIG. 1 shows a lengthwise section of the principal design of an explosive charge with primary and secondary liners and a symbolically indicated ammunition unit, in which the explosive charge is attached or attachable.

DETAILED EMBODIMENT DESCRIPTION

Figure 1:
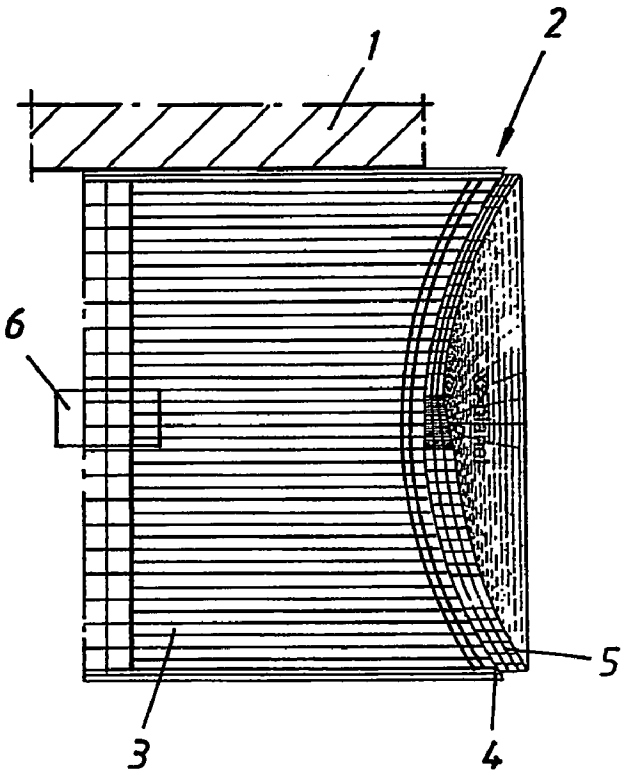

FIG. 1 show, with symbolic designation 1, an ammunition unit in question that can be represented by a missile, projectile etc. The ammunition unit is equipped with a unit 2 that includes an explosive charge 3 and a primary liner 4. In connection to the primary liner a secondary liner 5 is arranged. In connection with the explosive charge there is also an initiation charge 6, by means of which the unit 2 is activated.

Figure 2:
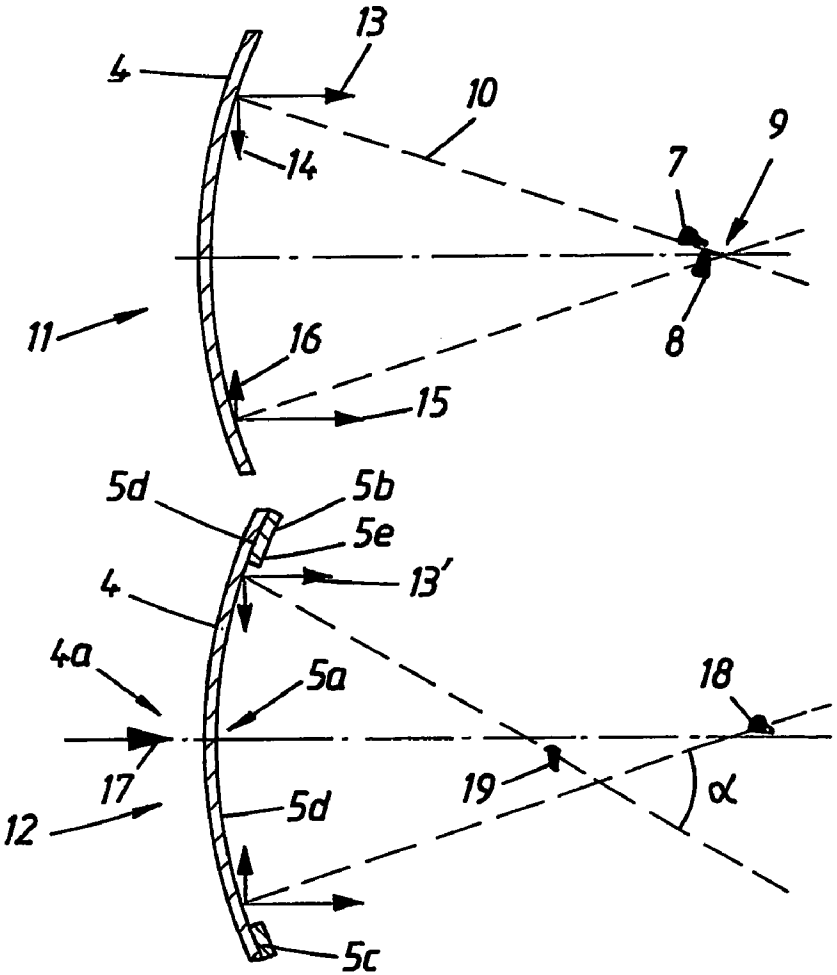
FIG. 2 shows, in cross section and on principle, the functional principle for attaining SCW effect and fragmentation effect.

The explosive charge may, in accordance with FIG. 2, be so selected as to work in two different functions. In a first function the explosive charge is equipped with only the liner 4. The liner 4 is arranged with equal thickness in a manner that is, in and of itself, known and achieves SCW effect at its independent function. The material 7, 8 emanating from the liner 4 upon activation of the explosive charge 3 (see FIG. 1) is concentrated to a collision point 9 and in this way the SCW function in question is attained. The exiting particle flow 7, 8 occurs within a cone, symbolically designated with 10. The function in question is actually known, and thus can be referred to from the perspective of prior art.

Figures 3, 4, 5, 6:
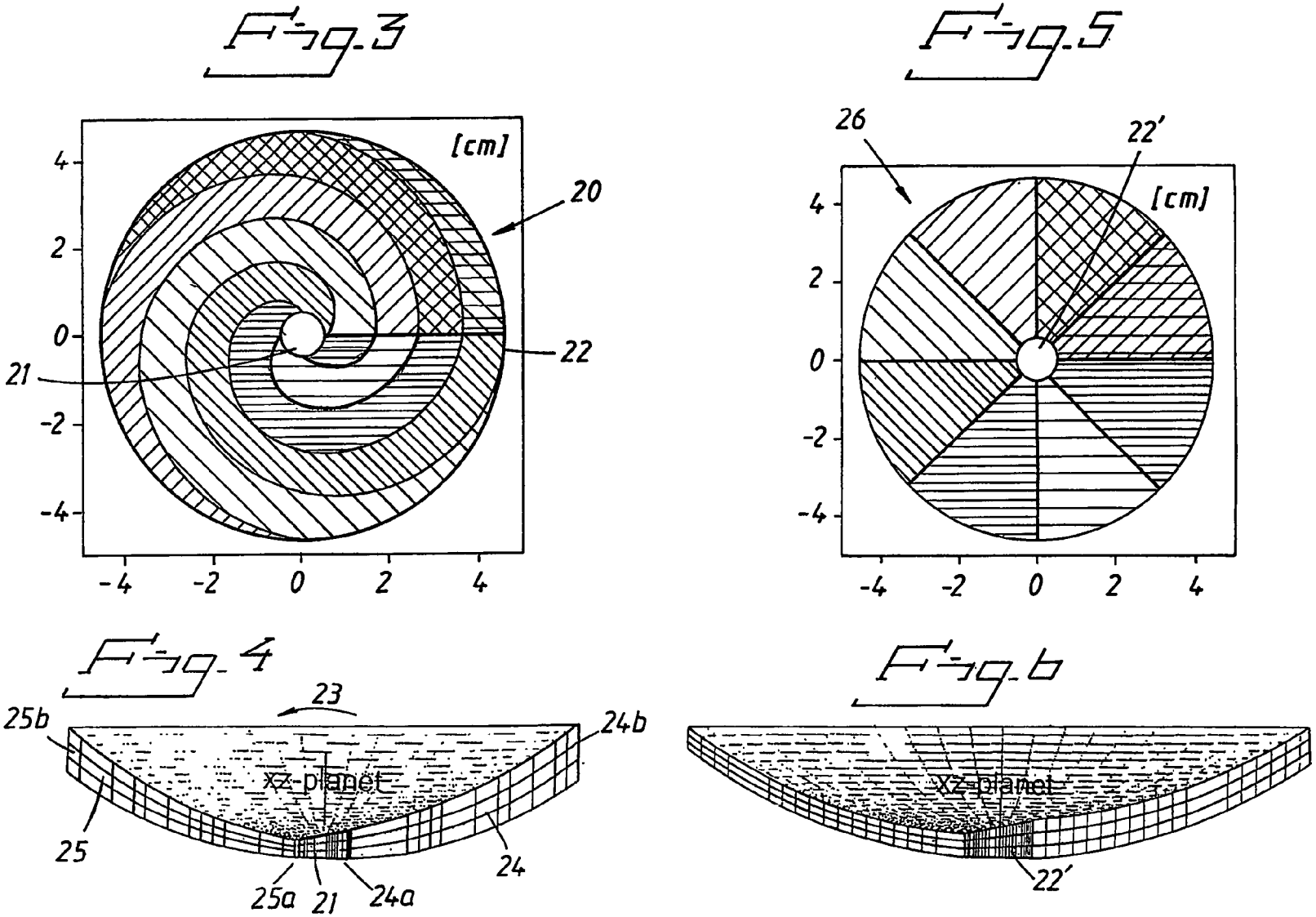
FIG. 3 shows, in horizontal view, a first embodiment of the secondary liner with fitted helical sub-surfaces.
FIG. 4 shows, in a perspective from above, parts of the second liner's interior and exterior side surfaces.
FIG. 5 shows, in horizontal view, a second embodiment with helical sub-surface parts but which share the same radial thickness.
FIG. 6 shows, in a perspective top view, parts of the interior side surfaces from the secondary liner.

FIG. 2 shows a selection, symbolically designated with 11, to ready the ammunition unit for the SCW function in question. The liner 4 may be connected or attached to the secondary liner 5, though only partially indicated in FIG. 2, with another selection symbolically designated with 12. A distinguishing characteristic for the secondary liner is that it is asymmetrical and not of equal thickness. The liner can be thinnest in the middle parts and grow in thickness outwards radially. The thickness of the liner can also be varied in the circumferential or angular direction. FIG. 2 shows the particle velocity symbolically designated with 13, 14 and 15, 16. The particle velocities can be varied by means of the asymmetry derived from the secondary liner, as is indicated by comparing particle velocities 13, 13' in the ammunition unit direction of flight 17. The effect of particle velocity disallows the occurrence of apparent collision at point 9, but rather that free-flying particles 18, 19 can be obtained in the ammunition unit's forward direction, e.g., within a cone whose top angle is designated with $\alpha$. The inner surface of the secondary liner can be divided into helical sub-surfaces 20 that partially extend beyond one another, as is in accordance with FIGS. 3 and 4. The secondary liner is embodied with a center hole 21, from which the radial thickening extends toward the liner's outer circumference 22. The thickness can vary in circumferential or angular direction 23, in accordance with FIG. 4. In FIG. 4 this is symbolically designated by having side surface 24 being thicker than side surface 25. The radially outward extended thickening is also indicated by means of 24*a*, 24*b* and 25*a*, 25*b*, respectively. The cooperative sub-surfaces are designed as sectors 26 with gradually increasing thickness arranged side by side to one another, in accordance with FIGS. 5 and 6. Thickness variations also apply in this case, as is in accordance with FIGS. 3 and 4.

Figures 7, 8, 9, 10:
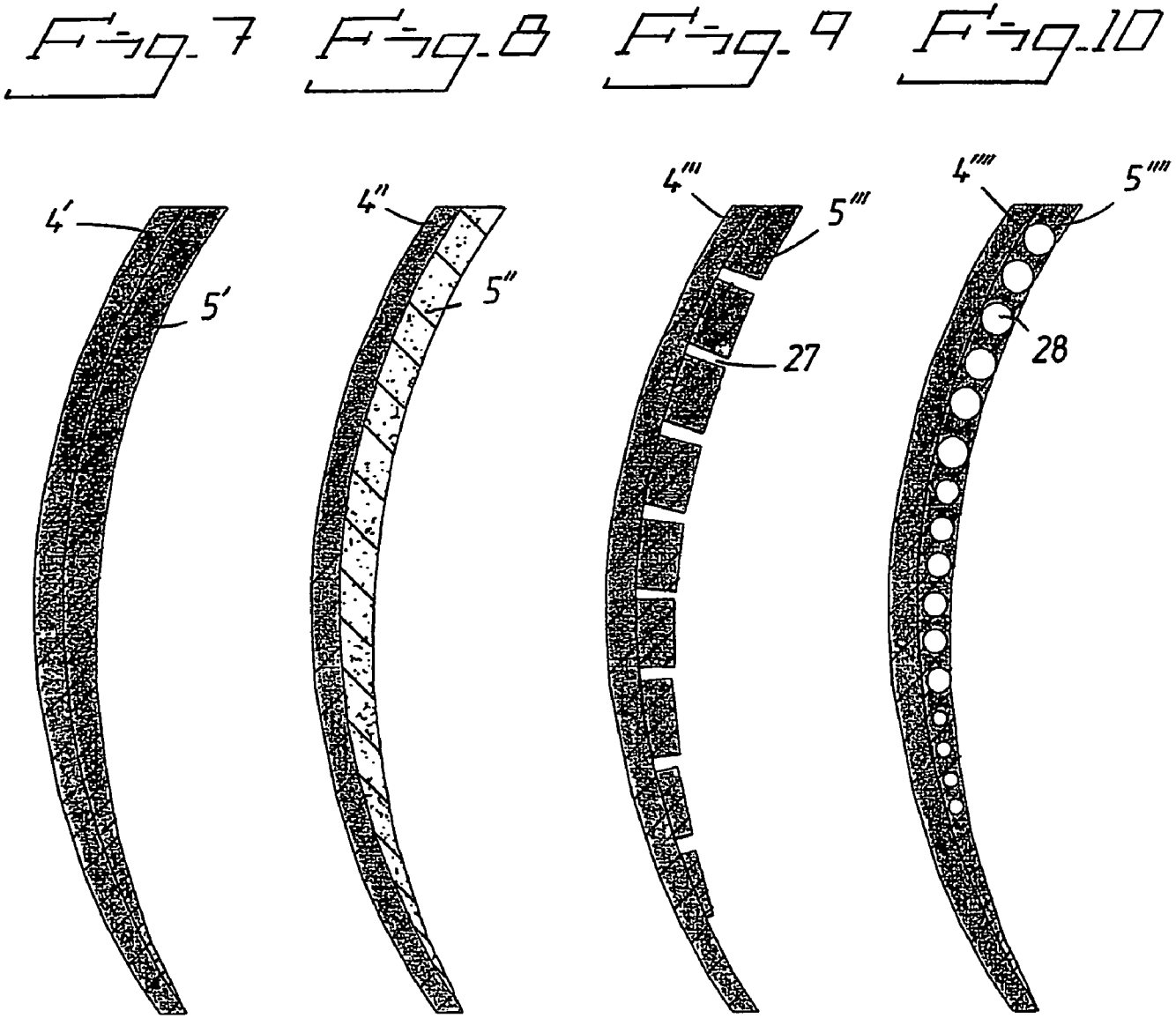
FIGS. 7-10 show, in cross section, different embodiments of, in part, the liner for the SCW effect and, in part, the secondary liner or additive unit.

FIGS. 7-10 show given cross sections of the primary liners 4', 4", 4'" and 4"" and the secondary liners 5', 5", 5'" and 5"", respectively. In the case indicated by FIG. 7, the primary liner 4' and secondary liner 5' are comprised of the same material. The material used can be a ductile metal or alloyed metal, e.g. copper. Alternatively, nickel, zinc, aluminium, tantalum, tungsten, etc. can be used. The secondary liner 5", in the embodiment example indicated in FIG. 8, is comprised of a brittle metal that increases fragmentation effect. This material may also be selected from material actually known by prior art. FIGS. 9 and 10 show that the secondary liner 5'" and 5"" may be prefragmented in order to facilitate the formation of fragments. The embodiment indicated in FIG. 9 has, in principle, the secondary liner slotted in a radial direction. The slots are symbolically designated with 27. The secondary liner 5"", equipped with circumferentially distended holes 28, whose diameters are distended or vary depending on the thickness, as indicated by the embodiment in FIG. 10.

The primary and secondary liners 4, 5 are arranged with essentially convex shape, where the form opening is forwardly directed in a direction of motion 17 for an explosive charge bearing ammunition unit. The secondary liner's rear surface 5*d* is equipped with a design that essentially corresponds to the convex surface 5*d* on the primary liner. Fixture devices, not especially displayed, for holding the secondary liner in position in the primary liner's convex surface 5*d* can, thus, be used to facilitate the application or removal of the secondary liner 5*b*, 5*c* to or from the primary liner 4. The thickness variation, apparent in the present case, can be devised evenly or without gradual transitions. Certainly it is possible to also design the thickness variation gradually. The secondary liner 5 has a convex inner surface symbolically designated with 5*e*.

ALTERNATIVE EMBODIMENTS

The present invention is not limited to the embodiments indicated above, but can be subjected to modifications within the framework of the subsequent patent claims and the invention concept.

The invention claimed is:

1. A device at an explosive charge comprising:

a primary liner and a secondary liner being arrangeable to each other such that different combat capabilities are made possible, the primary liner being arranged at a first selection to be able to function independently and by employment of a symmetrical form to achieve a forward-aimed Shaped Charge Warhead (SCW) effect upon initiation of the explosive charge with emitted material from the primary liner, the secondary liner being arranged by means of a second selection to be able to function together with the primary liner and together cause a forward-directed fragmentation effect, wherein the primary liner and the secondary liner are arranged to cause an asymmetrical form that upon the initiation of the explosive charge passes on different velocities to the emitted material of the liners, wherein the secondary liner is thinnest in a middle part and devised with a radially outwards and evenly increasing thickness, and wherein the secondary liner is also devised with a thickness variation in a circumferential or angular direction to obtain emitted material and disallowing the occurrence of a material collision in a forward direction.

2. A device in accordance with claim 1, wherein the primary and secondary liners are arranged with an essentially convex form having an opening, wherein the opening is aimed forwardly in a direction of motion for an explosive charge bearing ammunition unit, and wherein a rear surface of the secondary liner has an embodiment that essentially corresponds to the convex surface of the primary liner.

3. A device in accordance with claim 1, wherein the primary liner is arranged with an essentially equal thickness with regard to its radial or diametrical extensions.

4. A device in accordance with claim 1, wherein the secondary liner has an inner surface or convex surface formed by a number of surface sector parts fitted next to one another.

5. A device in accordance with claim 1, wherein the secondary liner has an inner surface formed by a number of partly overlapping helical sub-surfaces.

6. A device in accordance with claim 1, wherein the secondary liner has a center hole.

7. A device in accordance with claim 1, the secondary liner is made of compact or prefragmented material.

8. A device in accordance with claim 1, wherein the primary and secondary liner are embodied in essentially the same material.

9. A device in accordance with claim 1, wherein the secondary liner is made of brittle material.

10. A device in accordance with claim 1, wherein the secondary liner has a prefragmented design.

11. A device in accordance with claim 1, wherein the ammunition unit is equipped during production with the primary and secondary liners and wherein the secondary liner is devised so as to be removable in case of the first selection.

12. A device in accordance with claim 2, wherein the ammunition unit is a missile or a projectile.

13. A device in accordance with claim 2, wherein the primary liner is arranged with an essentially equal thickness with regard to its radial or diametrical extensions.

14. A device in accordance with claim 2, wherein the secondary liner is devised with a radially outwards and evenly increasing thickness.

15. A device in accordance with claim 3, wherein the secondary liner is devised with a radially outwards and evenly increasing thickness.

16. A device in accordance with claim 2, wherein the secondary liner has a center hole.

17. A device in accordance with claim 3, wherein the secondary liner has a center hole.

18. A device in accordance with claim 1, wherein the secondary liner has a center hole.

* * * * *